United States Patent [19]

Darmstadt

[11] 4,047,335

[45] Sept. 13, 1977

[54] PNEUMATIC LOAD-SUPPORTING STRUCTURES

[76] Inventor: Robert M. Darmstadt, 22 G Meadow Green Circle, Englishtown, N.J. 07726

[21] Appl. No.: 633,074

[22] Filed: Nov. 18, 1975

[51] Int. Cl.[2] ..... E04B 1/345

[52] U.S. Cl. ..... 52/2

[58] Field of Search ..... 52/2; 244/5, 24, 25, 244/31, 128; 9/2 A, 11 A, 310 F

[56] References Cited

U.S. PATENT DOCUMENTS

| | | | |
|---|---|---|---|
| 1,658,876 | 2/1928 | Arnstein | 244/128 |
| 1,825,800 | 10/1931 | Houseman | 52/83 |
| 2,778,585 | 1/1957 | Tschudy | 244/128 |
| 2,888,675 | 5/1955 | Pratt | 244/31 |
| 3,042,050 | 7/1962 | Finlayson | 52/2 |
| 3,130,406 | 4/1964 | Jones-Hinton | 52/2 |
| 3,169,542 | 2/1965 | Neumark | 52/2 |
| 3,338,000 | 8/1967 | Ostrander | 52/2 |
| 3,410,039 | 11/1968 | Brezina | 52/83 |

FOREIGN PATENT DOCUMENTS

| | | | |
|---|---|---|---|
| 485,086 | 3/1970 | Switzerland | 52/83 |
| 238,118 | 7/1969 | U.S.S.R. | 52/83 |

*Primary Examiner*—Price C. Faw, Jr.
*Assistant Examiner*—Henry Raduazo
*Attorney, Agent, or Firm*—Jacobs & Jacobs

[57] ABSTRACT

A pneumatic structure, suitable for use as a roof, employs a series of upper and lower cables connected via vertical diaphragms and disposed within an inflated envelope such that a load imposed on the upper surface of the inflated envelope will be transferred to the lower cables via the diaphragms and then taken up by the lower cables. To carry this out, there is a common connection between the diaphragm, its upper cable and the upper surface of the membrane and a similar connection with the lower cable, the diaphragm and the membrane.

A pneumatic compression ring is also disclosed for use with the pneumatic roof structure or for use in supporting an alternative roof structure, or a segment thereof may be used as a pneumatic arch.

18 Claims, 9 Drawing Figures

FIG. 1
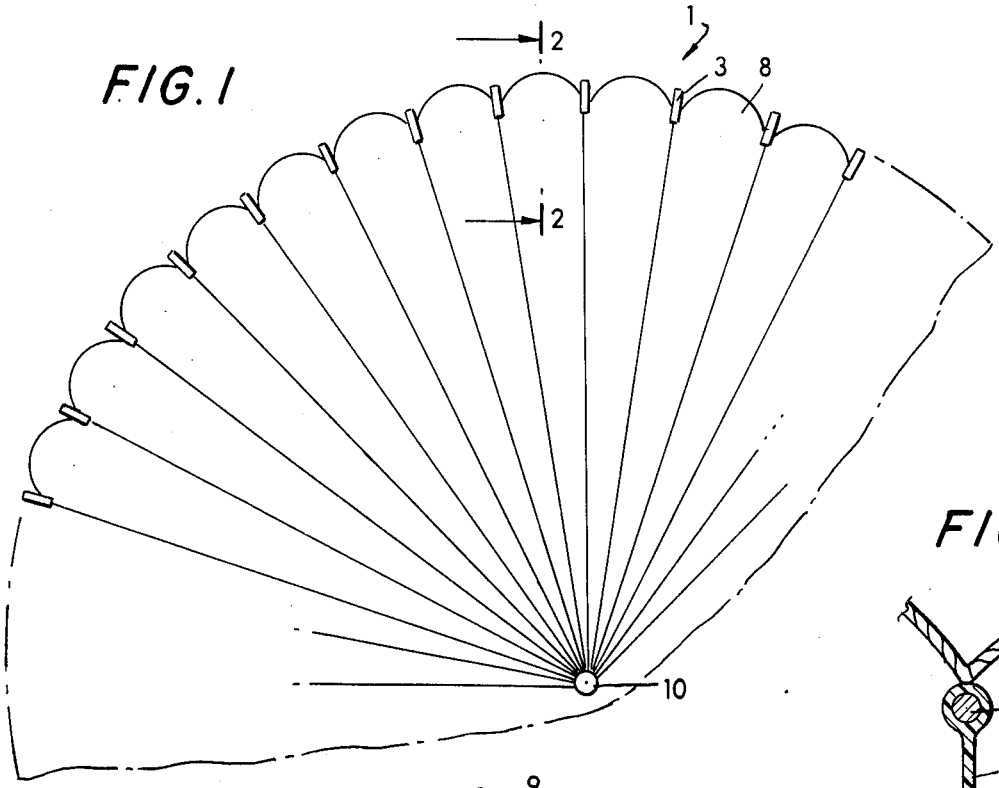
FIG. 3
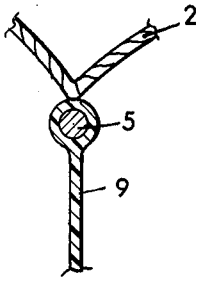
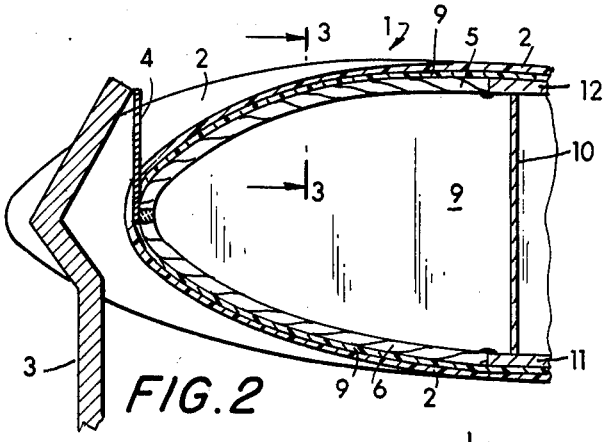
FIG. 2
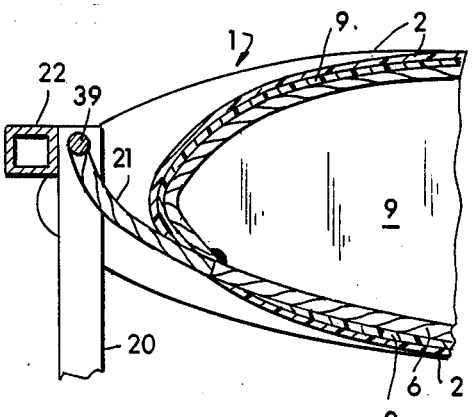
FIG. 4
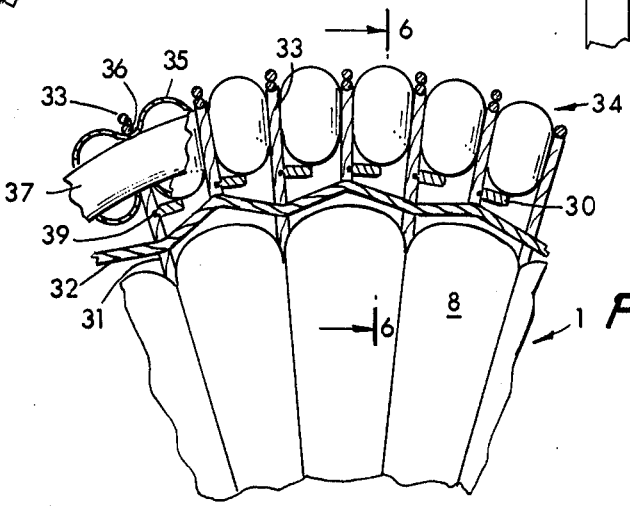
FIG. 5

PNEUMATIC LOAD-SUPPORTING STRUCTURES

The present invention relates to pneumatic structures, and particularly to pneumatic structures capable of carrying substantial loads.

A variety of pneumatic structures exist in the prior art. In its simplest form, the pneumatic structure is a huge balloon enclosing the desired volume and inflated with air so as to be held up by internal air pressure. This is the structure commonly used to enclose a swimming pools, tennis courts, and the like. While useful, these structures have inherent size limitations and require large blowers, or the like, and air locks to maintain the internal pressure.

Pontoon bridges, and the like, are also known, which basically comprise an inflated bag wherein air pressure in the bag cooperates with buoyant force of water to support a load.

Roof structures are known, comprising an inflated bag held in a network of supporting cables. In these cases, the cables are the load-supporting member and the skin of the inflated bag serves to transmit snow load and the like to the cables. Further, the bag does not resolve any of the internal horizontal forces.

The present invention is based on a novel pneumatic structure in which a gas, preferably air, under pressure is used to inflate an inflatable structure, a cable system is used to carry part of the load and a diaphragm system is used to transmit the load from the outside of the structure to the cables.

The present invention is illustrated by the accompanying drawings in which:

FIG. 1 is a top plan view of an inflatable structure of the invention suitable for use as a roof;

FIG. 2 is a view, in section, taken along lines 2—2 in FIG. 1;

FIG. 3 is a detail view, in section, and in enlarged scale, taken along line 3—3 in FIG. 2;

FIG. 4 is a view, in section, similar to FIG. 2, of another embodiment of the invention;

FIG. 5 is a top plan view, similar to FIG. 1, of another embodiment of the invention;

Figure 6:
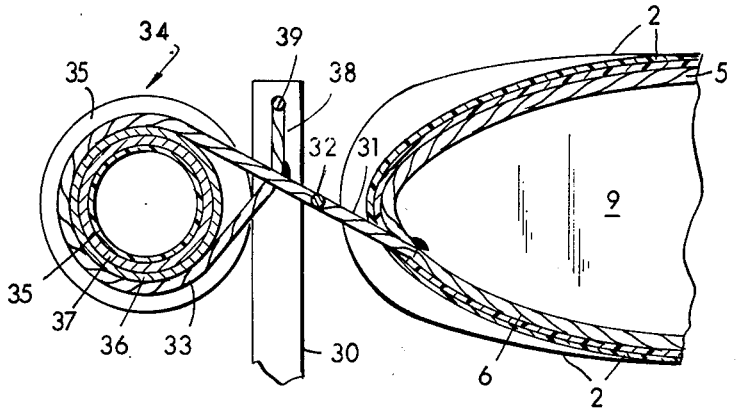
FIG. 6 is a view, in section, similar to FIG. 2, taken along lines 6—6 in FIG. 5.

FIG. 1 shows the roof structure 1 of the present invention in the form of an inflated ellipsoidal membrane 2 suspended from a series of steel columns 3. As more clearly shown in FIG. 2, a suspender cable 4 connects the steel column 3 to upper and lower cables 5 and 6 carried within the skin of the membrane 2. The membrane 2 is formed from a series of wedge-shaped sections 8, each section 8 having a pair of converging sides formed by opposed converging diaphragms 9 and an outer surface formed by the membrane 2. Each section 8 is provided with valved gas inlet means (not shown) to permit inflation of the membrane 2. Each diaphragm 9 is joined to a central tendon 10, which is carried by a place 11. Plate 11 may be a ring or other structure. The upper cables 5 are joined to the plate 12 (FIG. 2) and the lower cables 6 are joined to the plate 11 (FIG. 2). Cables 5 and 6 are joined together, as by welding or the like, and are connected to the suspender cable 4 by any suitable connection means, such as welding or the like. Suspender cable 4 and the upper and lower cables 5 and 6 may preferably include vibration dampeners (not shown).

As can be seen from FIG. 2, a pair of diaphragms 9 and their associated cables 5 and 6, which lie in the same vertical plane, provide the structure 1 with a substantially elliptical vertical cross-section when the structure is inflated. The membrane 2 may be any of the materials customarily used for inflated structures, such as opaque, translucent or transparent nylon, fiberglass, polyester, vinyl or polyolefin, and the material used for the membrane may be treated, if desired, to increase the waterproof and weatherproof properties thereof. The precise construction of the fabric used is not a feature of the present invention, and is well within the expertise of one skilled in the art.

The upper and lower cables 5 and 6 are preferably glass fiber reinforced plastic or steel cables and in a structure 1 of approximately 120 feet in diameter, which is inflated to a pressure of 8 psig, it has been found suitable to use cables of approximately ½-inch in diameter. The fabric used for the membrane 2 will have a thickness of about 0.030 inches, and the diaphragms 9 will preferably be made of the same fabric used for the membrane 2 and will have a thickness of approximately 0.025 to 0.050 inches.

It is an essential feature of the present invention that the diaphragm 9 be joined to the cables 5 and 6 in such a manner as to provide a common connection between the membrane 2, the diaphram 9 and the respective cables 5 and 6. This connection is shown in more detail in FIG. 3 for the upper cable 5, and it is understood that the lower cable 6 is connected to the diaphragm 9 and membrane 2 in a similar manner. As shown in FIG. 3, the diaphragm 9 terminates in a loop 9*a* through which is threaded the cable 5, and membrane 2 is attached to loop 9*a* as by heat sealing, sewing or cementing, or the like. The elliptical cross-section, in combination with the common connection between the membrane 2, the cables 5 or 6 and the diaphragm 9, coact to carry the load applied to the top of the structure 1, such as rain, wind or snow. The upper cable 5 is present to insure that the elliptical cross-section is maintained.

Thus, the live load is transferred to the lower cables 6 by a reduction in the tension in the diaphragms 9. The diaphragms 9 are normally under tension as a result of the internal pressure in the structure. When the live load is imposed on the structure 1, the cable 6 will thus sag and the major diameter of the elliptical cross-section will decrease. The increased sag in the cable 6 picks up the load corresponding to the live load. Accordingly, the present invention does not rely exclusively on the load-carrying properties of the membrane 2 to support the applied load, and substantially larger loads can be carried due to the cables 6.

The elliptical cross-section results in sufficient static radial forces to resolve internal horizontal forces resulting from the air pressure and the applied load. The elliptical shape thus reduces the need for a compression ring, or the like, even in structures as large as 120 feet in diameter. Consequently, for the embodiment shown in FIGS. 1 and 2, there are only vertical forces external of the structure 1, and hence the suspender cable 4 is employed only to resolve external vertical forces. No peripheral support is required except for wind loads.

A preferred equation for the elliptical shape is $1/6\ W_1X^3 + 1/6\ W_2Y^3 - P_oY = O$, where X and Y are the coordinates of the curve, $W_1$ and $W_2$ are constants and $P_o$ represents the tension in pounds of each cable at the midpoint.

Because of the unique resolution of forces provided by the structure 1 of the present invention, the diaphragms 9 need be reinforced only in a vertical direction, since the diaphragms resolve only vertical forces. The cables 6 provide restraint for substantially all of the horizontal component of the internal pressure and only a very small portion of the vertical component of this pressure.

It can readily be seen that the structure 1 as shown in FIGS. 1 and 2 is a light weight structure capable of supporting very large loads. When used as a roof, it is not necessary for the volume enclosed by the roof to be pressurized.

FIG. 1 shows the preferred embodiment of the invention wherein the diaphragms 9 converge to a central point. The structure need not be so limited since some or all of the diaphragms can be parallel.

In a preferred embodiment of the invention, the diaphragm 9 is reinforced both horizontally and vertically. This has the advantage of having a diaphragm 9, under no live load conditions, carrying approximately one-half of the horizontal pressure load on sections 8. Cables 5 and 6 carry a small portion of the vertical component of the pressure load and approximately one-half of the horizontal pressure load (under no live load conditions). When the diaphragm 9 is reinforced both horizontally and vertically, the preferred equation for the elliptical shape remains the same as described above. In this embodiment of the invention, when a live load is applied to the membrane 2, it will first be transferred through the diaphragm 9 to the cables 6. Cables 6 will sag and the major diameter of the elliptical cross-section will decrease. This decreases the tension in the horizontal reinforcing of diaphragm 9 and the cables 6 take up the load corresponding to the reduction in tension of the horizontal reinforcing. The additional horizontal load on cables 6 offsets the increase in vertical load, i.e. the live load, so that any change in the shape of the structure 1 is minimized. Accordingly, with the use of the horizontally and vertically reinforced diaphragms 9, structure 1 becomes essentially self-correcting for changes in shape due to the imposition of loads, and hence the structure is amenable to very large sizes.

The design of the structures must take into account the size of the structure 1 as well as the loads to be encountered. Adjustments can be made in the tension of the cable 6 and the vertical tension in the diaphragms 9, to insure that the load is properly carried. As an example of suitable tensions, for a structure shown in FIGS. 1 and 2 of 120 feet in diameter, the cable 6 will be under a tension of 110,000 psi, and the diaphragm 9 will be reinforced to support a tension of 17,000 psi, using the ½-inch fiberglass cables and the diaphragm of 0.025 to 0.05 inches. For a larger structure, such as about 200 feet in diameter, the cable 6 will be 1-1/16 inches in diameter and under a tension of 110,000 psi. The diaphragm 9 used in the embodiment shown in FIG. 3 will be reinforced to withstand a tension of 17,000 psi.

While it is certainly one of the major advantages of the present invention to avoid the need for a compression ring, or the like, external of the structure 1, in some instances the structure 1 may be so large as to require such a means. FIG. 4 illustrates the case wherein in place of the support columns 3, the structure 1 is now suspended from a series of steel columns 20 by means of cables 21, and a compression ring 22 encircles the columns 20. Compression ring 22 may be any conventional compression structure, such as a rigid hollow ring, shown for convenience in FIG. 4 as rectangular in cross-section, which is pressurized to pre-stress the structure. The embodiment shown in FIG. 4 is the structure 1 employing the single lower cable 6. The cable 21 is connected to the pin 39 and the lower cable 6 by any suitable means, as by welding or the like.

In a preferred embodiment of the invention, a pneumatic compression member is employed, as shown in FIGS. 5 and 6. As can be seen from these FIGURES, in place of the support columns 3, the structure 1 is now supported by columns 30 through the cables 31, 32, 33 and 38. In particular, cable 33 is looped around the compression member 34 and is attached to a balancing cable 32. A series of suspender cables 31 is connected to the balancing cable 32 at one end and to the cables 5 and 6 of structure 1 at the other end. Cable 38 is suspended from pin or stud 39 and is connected between the pin 39 and the cable 33.

The compression member 34 is an inflated pneumatic compression ring made from the same type of fabric used for the membrane 2. For a structure of 120 feet in diameter, the compression member 34 will have an inside diameter of approximately 10 feet and will be inflated to an internal pressure of approximately 25 psig. The thickness of the skin 35 (FIG. 5) of the compression member 34 will normally be in the range of about 0.025 to 0.050 inches in thickness. Spaced about the compression member 34 are a series of tension hoops 36, which, for the structure under discussion, would have a diameter of approximately 0.5 inches. The tension hoops 36 reinforce the skin 35 and preferably are made of steel. If desired, the tension hoops 36 may be substituted by a series of circular diaphragms, similar to the diaphragms 9, which would be stitched to the skin 35 in order to provide sufficient reinforcement of the skin 35. For a structure 1 of 120 feet in diameter, the compression structure 34 would have the tension hoops 36 or the diaphragms (not shown) spaced at approximately 3-foot intervals aaround the compression member 34.

In order to provide maximum capability of the tension tube to assume radial forces when the roof load is not applied fully, a tension tube 37 is provided within the compression member 34. Tension tube 37 is connected to the skin 35, as by stitching or the like, and is made of air-permeable material, such as very loosely woven fabric, in order to permit full inflation of the tension tube 37 and the skin 35. The tension tube may be conveniently made from polyester or similar material having a thickness of 0.050 inch.

Figure 7:
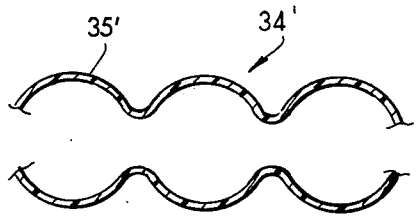
FIG. 7 is a detail view, in section and in enlarged scale, of another embodiment of the invention.

FIG. 7 shows a compression member 34', which is an alternative to the compression member 34 shown in FIGS. 5 and 6. Compression member 34' omits the tension tube 37, but the plastic skin 35' is pre-stressed so as to take up or relieve circumferential tension by having a series of arcs of less than 180° as shown, for example 140°–170°. If desired, the member 34' may also employ a series of radially spaced diaphragms (not shown) as a further means of supporting the compression member.

If the skin of the compression ring 34 is suitably reinforced circumferentially in both the horizontal and vertical directions, the tension hoops 36 can also be eliminated.

The pneumatic compression ring enables the production of quite light weight roof structures, which require supporting columns only around the outside of the periphery of the roof. The pneumatic compression ring allows the roof structure to be very large in diameter while minimizing the height of the roof that would otherwise be needed to accommodate large diameters. The weight of the pneumatic compression member relative to the radial forces produced thereby is smaller than that obtained with other types of compression rings, such as the pressurized steel compression rings. Through the use of the pneumatic compression ring, the load on the supporting columns 20 or 30 is entirely vertical, except for wind loads, thereby greatly reducing the structural supports.

Figure 8:
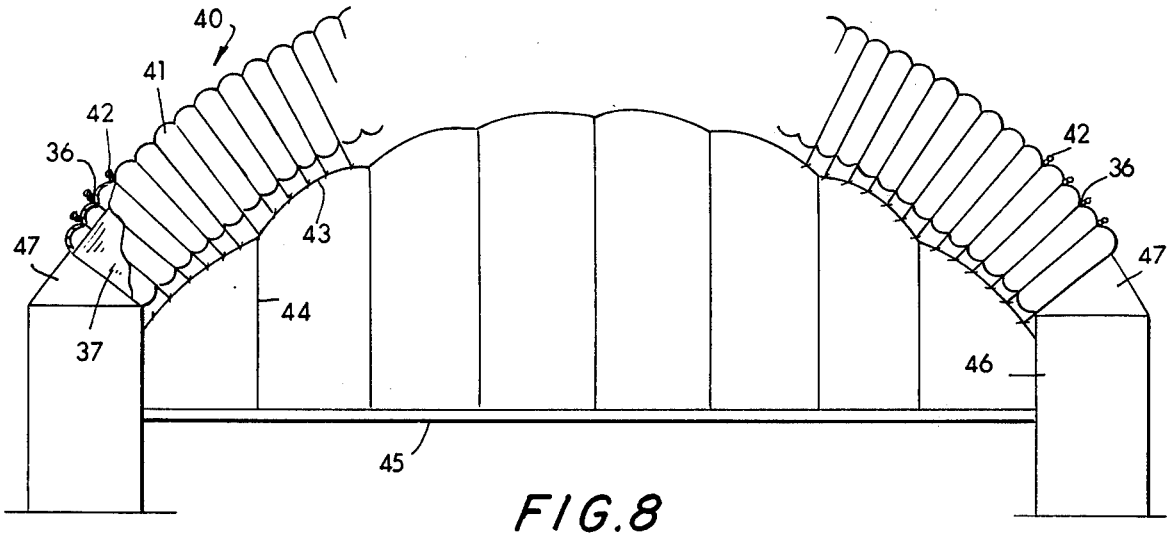
FIG. 8 is a side elevational view, partly in section, of a pneumatic arch according to the invention.

FIG. 8 shows a pneumtic arch using the principles of the pneumatic compression ring 34 or 34'. In FIG. 8, the arch structure 40 is actually a section, of approximately 90°, of the ring 34. The arch 40 is comprised of an inflatable membrane 41, which is reinforced either by the tension hoops 36 shown in FIGS. 4 and 5 or the internal circular diaphragms (not shown). In addition, the arch 40 may also include an inner tube 37, such as shown in FIGS. 5 and 6. A series of cables 42 are suspended from the arch 40 and are connected to a balancing cable 43, from which depend a series of suspension cables 44, which are ultimately connected to the deck 45. Support for the arch 40 is provided by the columns 46 and thrust blocks 47. The deck 45 is constructed in a conventional manner and is supported on each of its longitudnally extending edges by means of the arch 40 and cables 42, 43 and 44.

A tie (not shown) between the ends of the arch 40 may be used to eliminate, or at least minimize, the outward thrust of the arch. When a tie is used, the load of the arch at the ends will be entirely vertical.

The balancing cable 43, in addition to consolidating the radial forces of each of the tension hoops 36, also determines the curvature of the arch 40 at any particular point. The balancing cable 43, taken as a whole, is of parabolic catenary shape. Changes in the curvature of the arch 40 results in changes in the magnitude of the radial forces.

The pneumatic arch 40 provides a higher ratio of load-carrying capacity to weight. This is obtained because the components of the structure are subject to tension stresses only and very high strength materials can be used in tension. For comparable loads, the pneumatic arch can be constructed at substantially less weight than a conventional arch.

Figure 9:
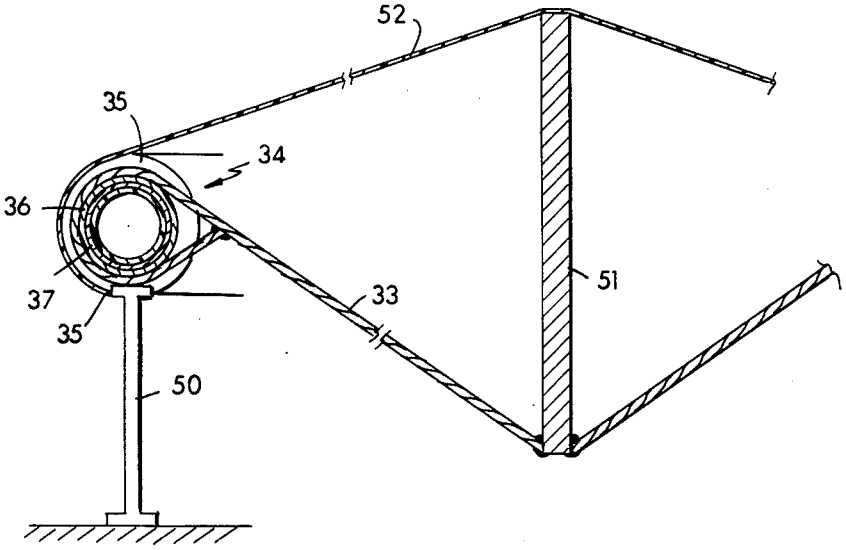
FIG. 9 is a side elevational view, in section, of a pneumatic ring used to provide a lightweight roof.

FIG. 9 illustrates yet another use of the pneumatic ring 34 shown in FIGS. 5 and 6. In this embodiment of the invention, the pneumatic ring 34 is supported by a set of columns 50, and the cables 33 (FIG. 6) extend around the tension hoops to a central column 51. A skin 52 is connected to the compression ring 34 and to the central column 51. Stay cables (not shown) are provided to stbilize the structure against wind forces.

If the skin of the compression ring 34 is suitably reinforced circumferentially in both the horizontal and vertical directions, the tension hoops 36 can also be eliminated.

The skin 52 used for the roof may be of the same material as is customarily used in these structures. By means of the construction shown in FIG. 9, a very light weight structure is provided to shelter a substantial area, and the skin 52 can be easily removed and reattached when needed.

What is claimed is:

1. A pneumatic structure, comprising:

a. an inflatable envelope having opposed, spaced upper and lower membranes;

b. a plurality of vertical diaphragms connected between said first and second membranes, said diaphragms being at least semi-elliptical with top and bottom curved edges that diverge from a common point with respect to the major axis of the ellipse, said diaphragms being reinforced vertically and being operable to resolve the vertical component of forces applied to the top of the envelope;

c. a plurality of upper cables, each upper cable being connected to the top edge of a diaphragm at the junction of the diaphragm and the first membrane;

d. a plurality of lower cables, each lower cable being connected to the bottom edge of a diaphragm at the junction of the diaphragm and the second membrane;

e. said upper and lower cables of each diaphragm being connected to each other near the periphery of said envelope;

f. means for inflating said envelope; and g. said cables and said diaphragms coacting to carry the load applied to the top of the envelope when inflated.

2. The structure according to claim 1, wherein the envelope, when inflated, is ellipsoidal, each diaphragm defining a semi-ellipse, and there is provided a central support, and top and bottom anchor means affixed to the support, the ends of the upper and lower cables remote from the periphery of said envelope being connected to said top and bottom anchor means, respectively, and the diaphragms being connected to said central support.

3. The structure according to claim 2, wherein the diaphragms are reinforced horizontally and vertically.

4. The structure according to claim 1, wherein at least some of the diaphragms are parallel.

5. A roof structure, comprising the pneumatic structure according to claim 1, which is inflated and which is supported by a plurality of vertical support columns around the periphery thereof, the lower cables being suspended from the columns.

6. The roof structure according to claim 5, including a compression ring means connected to said columns.

7. The roof structure according to claim 6, wherein said compression ring means is a pneumatic compression ring means comprising an inflated toroidal envelope having reinforcing means for relieving circumferential tension therein, said compression ring being supported by said columns through a plurality of looped cables extending circumferentially around sid toroidal envelope and attached via a hanger cable to said column, the looped cables being connected to a balancing cable extending around the peirphery of the roof, and said lower cables are suspended from said balancing cable.

8. The roof structure according to claim 7, wherein said reinforcing means are circular tension hoops spaced axially around said toroidal envelope.

9. The roof structure according to claim 7, wherein said reinforcing means are circular diaphragms connected to said toroidal envelope and spaced axially around the toroidal envelope.

10. The roof structure according to claim 7, wherein the reinforcing means is provided by pre-stressing the toroidal envelope to form a series of arcs of less than 180° spaced axially around the toroidal envelope.

11. The structure according to claim 3, wherein, under no live load conditions, said diaphragms are operable to carry approximately half of the horizontal pressure load on the surface of the inflated envelope and the lower cables are operable to carry the other half, whereby the structure is self-correcting for changes in shape.

12. A pneumatic structure, comprising:

a. an inflatable envelope having opposed, spaced upper and lower membranes, said envelope, when inflated, being ellipsoidal;

b. a plurality of vertical diaphragms connected between said first and second membranes, each diaphragm defining a semi-ellipse with top and bottom curved edges that diverge from a common point with respect to the major axis of the ellipse;

c. a plurality of upper cables, each upper cable being connected to the top edge of a diaphragm at the junction of the diaphragm and the first membrane;

d. a plurality of lower cables, each lower cable being connected to the bottom edge of a diaphragm at the junction of the diaphragm and the second membrane;

e. said upper and lower cables of each diaphragm being connected to each other near the periphery of said envelope;

f. means for inflating said envelope;

g. a central support, and top and bottom anchor means affixed to the support, the ends of the upper and lower cables remote from the periphery of said envelope being connected to said top and bottom anchor means, respectively, and the diaphragms being connected to said central support; and h. said cables and said diaphragms coacting to carry the load applied to the top of the envelope when inflated.

13. A roof structure, comprising the pneumatic structure according to claim 12, which is inflated and which is supported by a plurality of vertical support columns around the periphery thereof, the lower cables being suspended from the columns.

14. The roof structure according to claim 13, including a compression ring means connected to said columns.

15. The roof structure according to claim 14, wherein said compression ring means is a pneumatic compression ring means comprising an inflated toroidal envelope having reinforcing means for relieving circumferential tension therein, said compression ring being supported by said columns through a plurality of looped cables extending circumferentially around said toroidal envelope and attached via a hanger cable to said column, the looped cable being connected to a balancing cable extending around the periphery of the roof, and said lower cables are suspended from said balancing cable.

16. The roof structure according to claim 15, wherein said reinforcing means are circular tension hoops spaced axially around said toroidal envelope.

17. The roof structure according to claim 15, wherein said reinforcing means are circular diaphragms connected to said toroidal envelope and spaced axially around the toroidal envelope.

18. The roof structure according to claim 15, wherein the reinforcing means is provided by pre-stressing the toroidal envelope to form a series of arcs of less than 180° spaced axially around the toroidal envelope.

* * * * *